US006830406B2

(12) United States Patent
Kim et al.

(10) Patent No.: US 6,830,406 B2
(45) Date of Patent: Dec. 14, 2004

(54) ROTATION DEVICE OF A BUCKLE FOR USE IN AN VEHICLE SEAT BELT

(75) Inventors: Jung-han Kim, Wonju-shi (KR); Jae-ho Lee, Seoul (KR)

(73) Assignee: Delphi Automotive Systems Sungwoo Corporation, Seoul (KR)

( * ) Notice: Subject to any disclaimer, the term of this patent is extended or adjusted under 35 U.S.C. 154(b) by 132 days.

(21) Appl. No.: 09/957,474

(22) Filed: Sep. 21, 2001

(65) Prior Publication Data

US 2002/0113423 A1 Aug. 22, 2002

(30) Foreign Application Priority Data

Dec. 6, 2000 (KR) ..... 2000-73870

(51) Int. Cl.[7] ..... B60R 22/20
(52) U.S. Cl. ..... 403/120; 280/801.1
(58) Field of Search ..... 280/805, 801.1, 280/801.2; 297/470; 403/120, 119, 121, 112, 388

(56) References Cited

U.S. PATENT DOCUMENTS 4,323,205 A * 4/1982 Tsuge et al. ..... 280/805.1 X
4,569,535 A 2/1986 Haglund et al.
5,486,056 A * 1/1996 Thorn ..... 403/120 X
5,597,258 A * 1/1997 Kincaid et al. ..... 403/120 X
5,738,293 A * 4/1998 Fohl ..... 280/805.1 X

FOREIGN PATENT DOCUMENTS

JP 62-210154 9/1987

* cited by examiner

*Primary Examiner*—John R. Cottingham
(74) *Attorney, Agent, or Firm*—Banner & Witcoff, Ltd.

(57) ABSTRACT

A rotation device of a buckle for use in an automobile seat belt is provided with a base having a plate-like shape to be mounted on a bottom surface of a main body and provided with a circular plate portion at its one end, the circular plate portion provided with a through hole formed therethrough, and a pair of side walls bent upwardly each of which has a lug bent inwardly to be integrally formed with the circular plate portion as well as the pair of side walls, a stalk whose one end is rotatably mounted on an upper surface of the circular plate portion of the base has a hole formed therethrough and a stopper portion formed around the end of the stalk and provided with a protrusion for being contacted with an inner surface of the side wall of the base and an abutment for limiting a rotation angle of the main body, the stalk having a protrusion for stopping a rotational movement, an elastic member whose one end is contacted to the protrusion for stopping a rotational movement and having an elasticity and a through hole formed therethrough, so that the elastic member provide a restoring force when the main body is rotated, a rivet inserted into through hole of the circular plate portion of the base, the holes of the stalk and the elastic spring, and a fixing cap having a hole 135*a* for receiving an upper portion of the rivet to fix the components therebetween, a lug formed at one side thereof to be engaged with the lug formed with the side walls of the base.

8 Claims, 15 Drawing Sheets

ROTATION DEVICE OF A BUCKLE FOR USE IN AN VEHICLE SEAT BELT

FIELD OF THE INVENTION

The present invention relates to a rotation device of a buckle for use in an automobile seat belt; and, more particularly, to a rotation device of a buckle for used in an automobile or a vehicle having a reduced noise level during a rotation of a main body of the buckle and constructed to be easily assembled.

DESCRIPTION OF THE PRIOR ART

In general, an automobile or a vehicle is provided with a seat belt device for limiting the forwarding movement of the vehicle occupant, in an emergency situation, e.g., a collision or a crash, wherein a belt webbing whose one end is wound around a retractor mounted inside lower portion of pillar is introduced into the driver's compartment through an internal space of the pillar and a tongue provided in the other end through an anchor mounted on the pillar is insertable into a buckle fixed on a seat frame.

The buckle is rotatable in a predetermined angle through a rotation device. In FIG. 1, a conventional buckle is shown. As shown, the buckle is provided with a buckle main body 2 locking or releasing a tongue plate provided in a belt webbing (not shown), a stalk 3 rotatably connected to a rear portion of the main body 2 at its one end and fixed to a seat frame at the other end.

The main body 2 is made of resin and is provided with an insert hole (not shown) into which the tongue plate is insertable and has a push button (not shown) for releasing the tongue plate engaged into the insert hole.

The main body 2 constructed in this manner is connected to one end of the stalk 3 to be rotatable by a rotation device 4 mounted in a rear inner portion of the main body 2.

In other words, the rotation device 4 includes a bottom plate 5*a* made of a steel plate and seated on an inner bottom surface of the main body 2, a pair of side plates 5*b* formed by an upward bending process from the bottom plate 5*a* and having a pair of lugs 5*b*-l bent inwardly, respectively, a buckle base 5 provided with a circular plate portion integrally formed with one end of the bottom plate 5*a* and having a through hole 5*d* formed therethrough, a collar 6 having a cylindrical shape 6*b*, a flange 6*a* integrally formed with one end of the cylindrical shape 6*b*, which is seated on the circular plate portion 5*c* of the buckle base 5 to support the buckle base 5, allowing the buckle base 5 to pivot with respect to the stalk 3 in a width direction of the seat, a pair of guide portions 6*c* formed at both ends of the flange 6*a*, the guiding portion 6*c* surrounding a peripheral surface of the circular plate portion 5*c* and a protrusion portion 6*d* protruding from a portion from a center to a bottom of the cylindrical shape 6*b* to be eccentric, a stalk 3 having an insertion hole 3*d* into which the cylindrical shape 6*b* of the collar 6 is inserted, an elastic spring 7 positioned on an upper surface of the stalk 3 to allow the cylindrical shape 6*b* of the collar 6 to be inserted into the insertion hole 3*a*, a rivet 8 inserted into through hole 5*d* of the circular plate portion 5*c* of the buckle base 5, the collar 6, the stalk 3, and the elastic spring 7, and a fixing cap 9 having a hole 9*a* for receiving an upper portion of the rivet 8 to fix the components therebetween and a lug 9*b* engagable with the lug 5*b*-l formed with the side plates 5*b* of the buckle base 5.

On the other hand, there are shown another prior art buckle in FIGS. 3 and 4 which has a same function as that of the buckle shown in FIGS. 1 and 2. As shown, the buckle 10 is provided with a main body 11 for locking or releasing a tongue plate provided in a belt webbing, and a stalk 12 being rotatable at its one end, while the other end is fixed to a seat frame.

The main body 11 is made of resin and is provided with an insert hole (not shown) into which the tongue plate is insertable and a push button (11*a*) for releasing the tongue plate engaged into the insert hole.

The main body 11 constructed in this manner is connected to one end of the stalk 12 to be rotatable by a rotation device 13 mounted in a rear inner portion of the main body 11.

That is, the rotation device 13 includes a bottom plate 14*a* made of a steel plate and seated on an inner bottom surface of the main body 11, a pair of side plates 14*b* formed by an upward bending process from the bottom plate 14*a* and having a pair of cutouts 14*b*-l into which one end of the fixing cap 18 is engaged, a buckle base 14 provided with a circular plate portion 14*d* integrally formed with one end of the bottom plate 14*a* and having a through hole 14*c* formed therethrough and a pair of lugs 14*e* for an engagement with a collar 15 to be described later protruding from both ends of the circular plate portion 14*d*, a collar 15 having a cylindrical shape 15*b*, a flange 15*a* formed at one end of the cylindrical shape 15*b*, the flange 15*a* being seated on the circular plate portion 14*d* of the buckle base 14 to support the buckle base 14, allowing the buckle base 14 to pivot with respect to the stalk 12 in a width direction of the seat and a pair of recesses 15*c* for receiving the lugs 14*e* formed on the circular plate portion 14*d* of the buckle base 14, a stalk 12 having an insertion hole 12*a* into which the cylindrical shape 15*b* of the collar 15 is inserted and a pair of protrusions 12*b* outwardly extending from a peripheral surface, an elastic spring 16 positioned on an upper surface of the stalk 12 to allow the cylindrical shape 15*b* to be inserted into the insertion hole 12*a*, one end of the elastic spring 16 being engaged with the protrusion 12*b*, and the other end being fixed with respect to the fixing cap 18 described later, a rivet 17 inserted into through hole 14*c* of the circular plate portion 14*d* of the buckle base 14, the collar 15, the stalk 12, and the elastic spring 16, and a fixing cap 18 having a hole 18*a* for receiving an upper portion of the rivet 17 to fix the components therebetween, a pair of concave portions 18*b* formed around the fixing cap 18 to receive the other end of the elastic spring 16, and a lug 9*b* engagable into the cutouts 14*b–l* formed through the side plates 14*b* of the buckle base 14.

By the rotation device 4,13 mounted in the buckle 1,10 shown in FIGS. 1 through 4, the main body 2,11 of the buckle 1,10 is rotatable with respect to the seat and returned to an initial state.

That is, by the elastic spring 7,16 provided in the rotation device 4,13 of the buckle 1,10, the main body 2,11 is elastically rotated toward the vehicle occupant. At the moment, the operation of the elastic spring 7,16 and the returning action resulted therefrom are performed through the collar 6,15. The collar 6,15 not only causes an increase of the manufacturing cost and the manufacturing time but also results in noise when it comes into contact with the elastic spring.

SUMMARY OF THE INVENTION

It is, therefore, a primary object of the invention to provide a rotation device of a buckle for use in an automobile having an elastic spring without necessitating a collar or any equivalent therefor for its operation, thereby reducing the manufacturing cost, the manufacturing time and the occurrence of the noise.

In order to achieve the object, the present invention provides a rotation device of a buckle for use in an automobile seat belt is provided with a base having a plate-like shape to be mounted on a bottom surface of a main body and provided with a circular plate portion at its one end, the circular plate portion provided with a through hole formed therethrough, and a pair of side walls bent upwardly each of which has a lug bent inwardly to be integrally formed with the circular plate portion as well as the pair of side walls, a stalk whose one end is rotatably mounted on an upper surface of the circular plate portion of the base and has a hole formed therethrough and a stopper portion formed around the end of the stalk and provided with a protrusion for being contacted with an inner surface of the side wall of the base and an abutment for limiting a rotation angle of the main body, the stalk having a protrusion for stopping a rotational movement, an elastic member whose one end is contacted to the protrusion for stopping a rotational movement and having an elasticity and a through hole formed therethrough, so that the elastic member provide a restoring force when the main body is rotated, a rivet inserted into through hole of the circular plate portion of the base, the holes of the stalk and the elastic spring, and a fixing cap having a hole 135*a* for receiving an upper portion of the rivet to fix the components therebetween, a lug formed at one side thereof to be engaged with the lug formed with the side walls of the base.

In the rotation device, the elastic member is provided with a lower portion mounted on an upper surface of the stalk, an upper portion contacted with a bottom surface of the fixing cap, the lower portion having an arcuate shape containing the through hole and a protrusion receiver for receiving the protrusion for stopping the rotational movement, and the upper portion having a circular cross section, and a plurality of torsional holes formed through the elastic member.

In the rotation device, the stopper portion of the stalk is applied with plastic material.

In the rotation device, the fixing cap is provided with an insertion protrusion inserted into the torsional hole of the elastic member to allow the elastic member to be assembled at its twisted state when the fixing cap is assembled.

In the rotation device, the elastic member is made of one or compound of the group including the urethane, the rubber and the silicon.

In the rotation device, the elastic member is of a coil spring whose one end is contacted with the protrusion for stopping the rotational movement formed at the stopper portion of the stalk, while the other being kept on a peripheral surface of the fixing cap.

In the rotation device, an inner diameter of a hole formed through the lower portion of the elastic member is larger than that of the through hole of the upper portion.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

A preferred embodiment of the present invention is described with reference to accompanying drawings.

Figure 1:
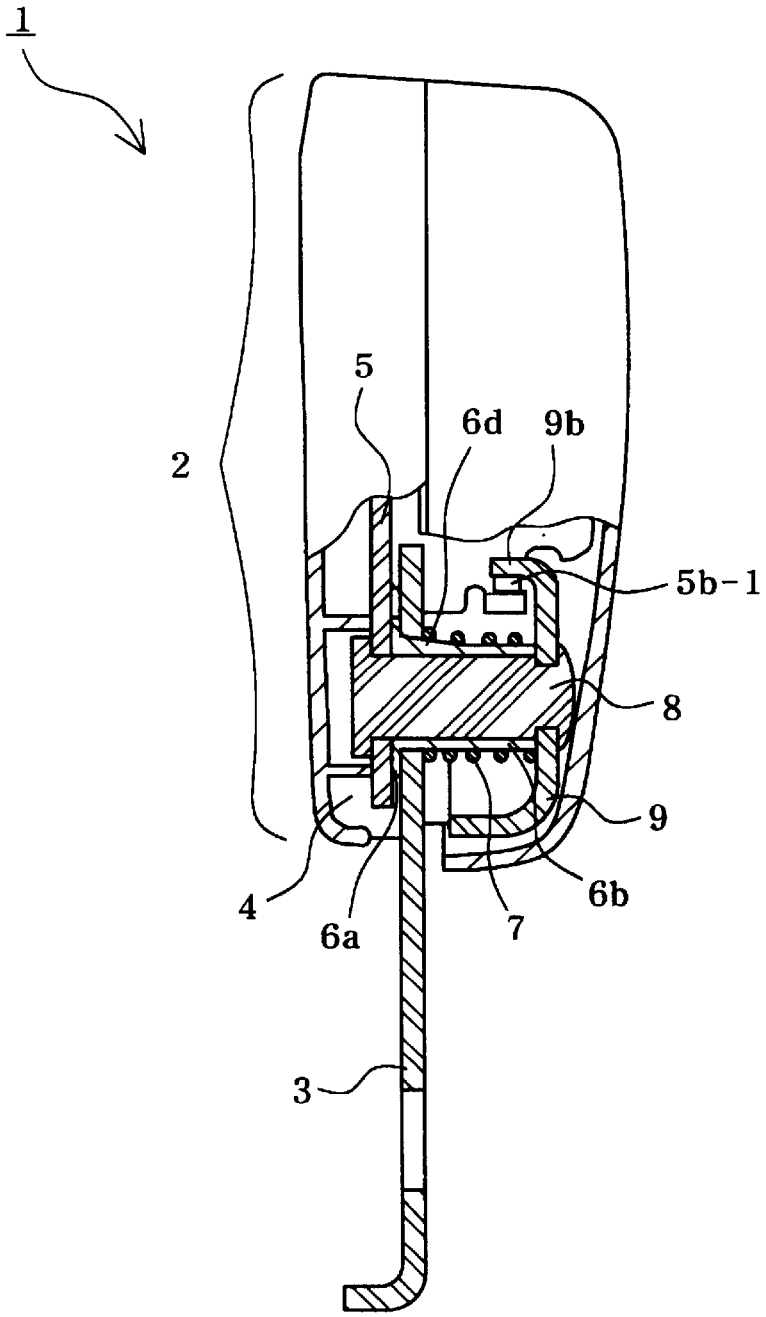
FIG.1 (PRIOR ART)
FIG. 1 illustrates a prior art buckle for use in an automobile seat belt.
Figure 2:
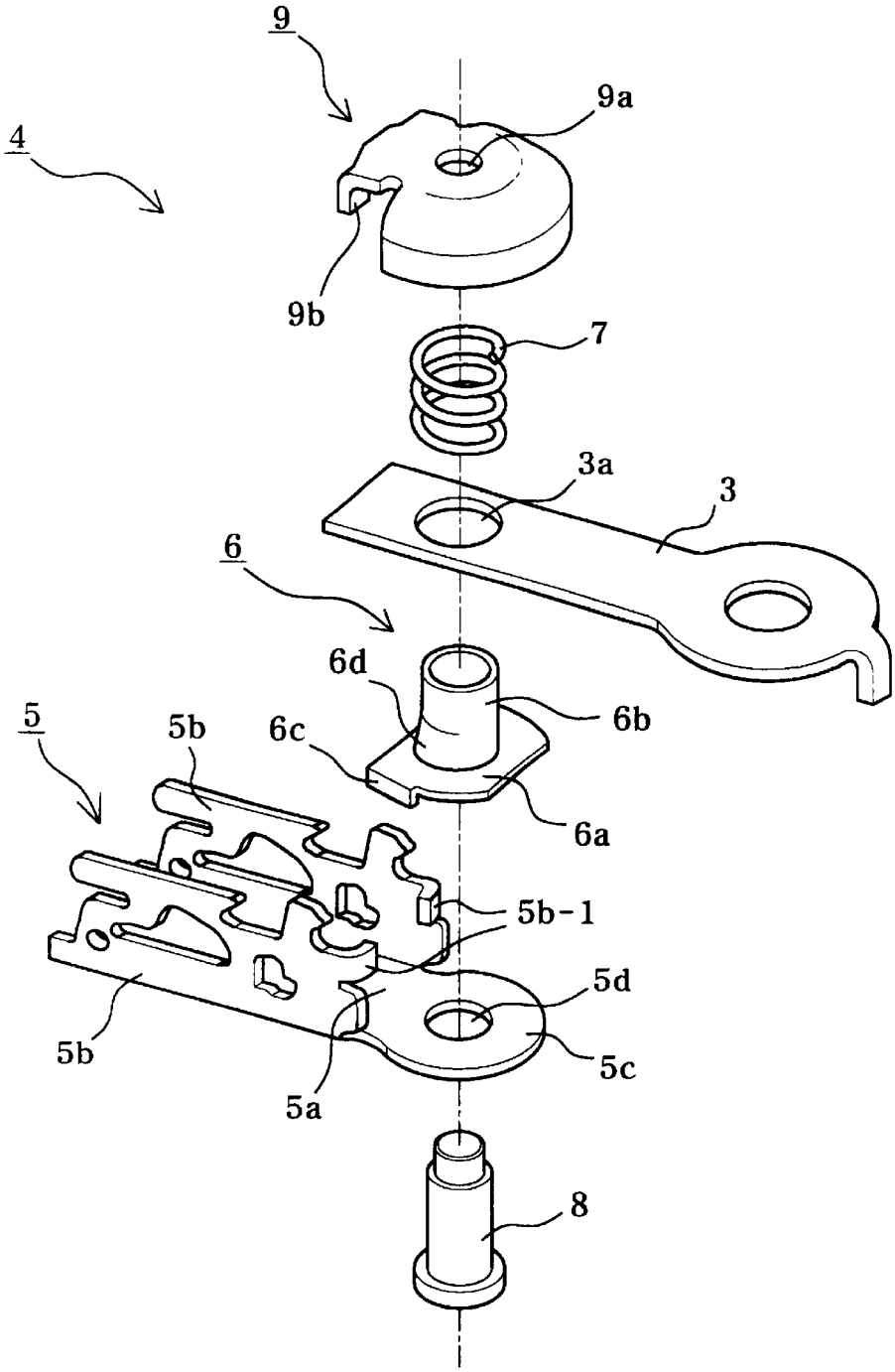
FIG.2 (PRIOR ART)
FIG. 2 shows an exploded perspective view of a rotation device of the prior art buckle shown in FIG. 1.
Figure 3:
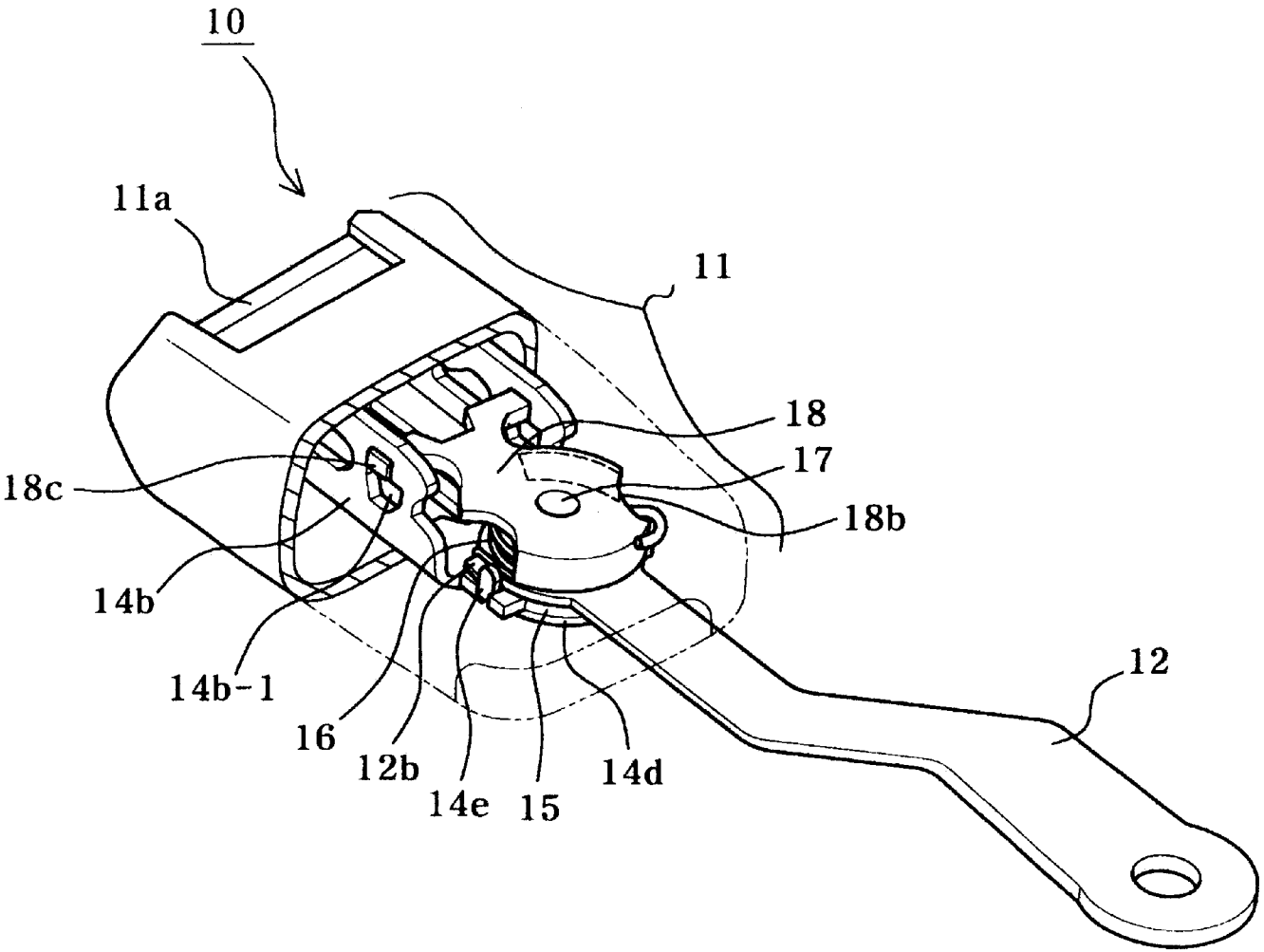
FIG.3 (PRIOR ART)
FIG. 3 depicts another prior art buckle for use in an automobile seat belt.
Figure 4:
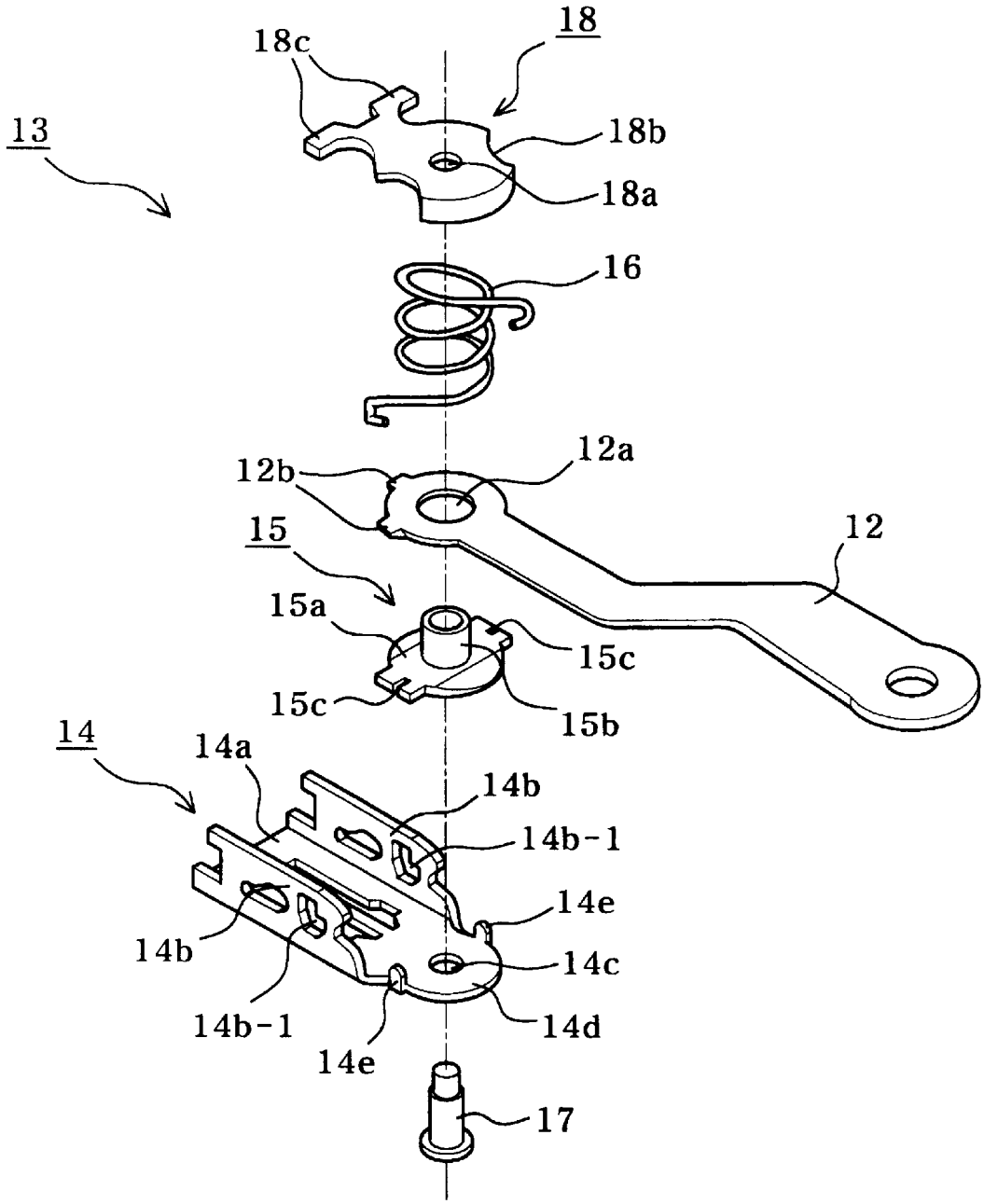
FIG.4 (PRIOR ART)
FIG. 4 presents an exploded perspective view of a rotation device of the prior art buckle shown in FIG. 1.
Figure 5:
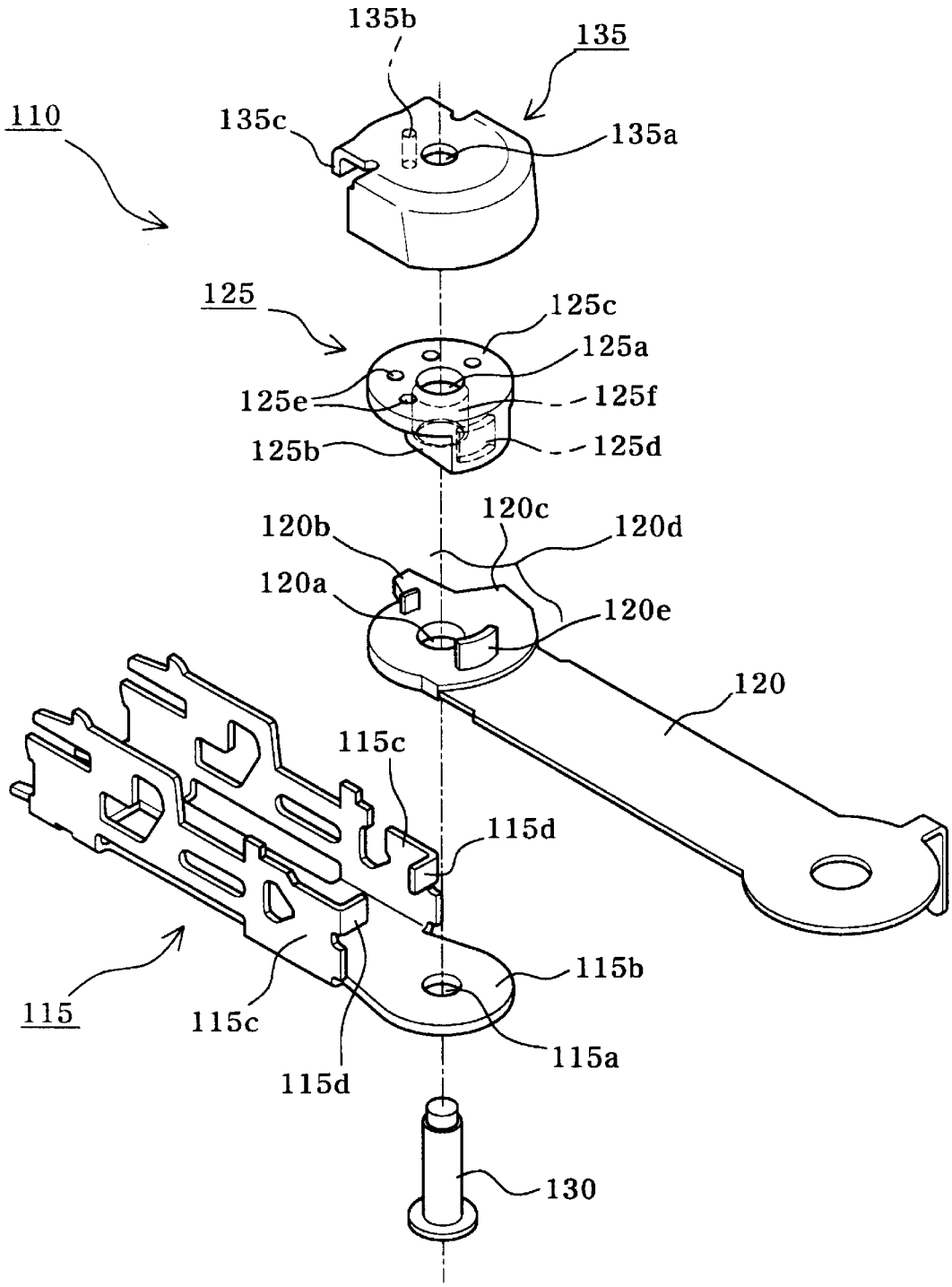
FIG. 5 illustrates an exploded perspective view a rotation device of a buckle for use in an automobile seat belt in accordance with a first embodiment of the present invention.
Figure 6A:
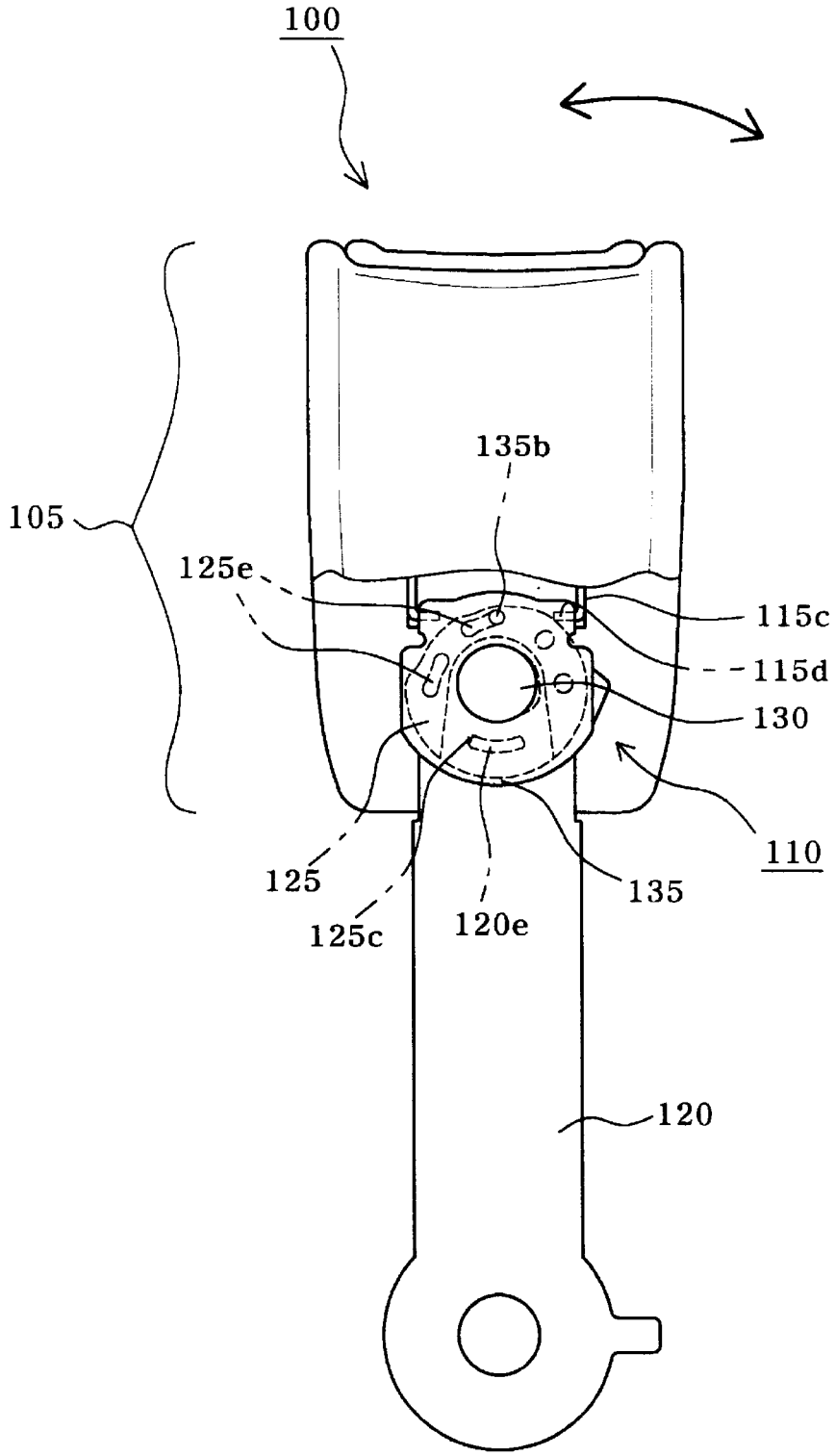
FIG. 6*a* shows a frontal elevational view of the buckle at its before-rotation state, which is equipped with the rotation device shown in FIG. 5.
Figure 6B:
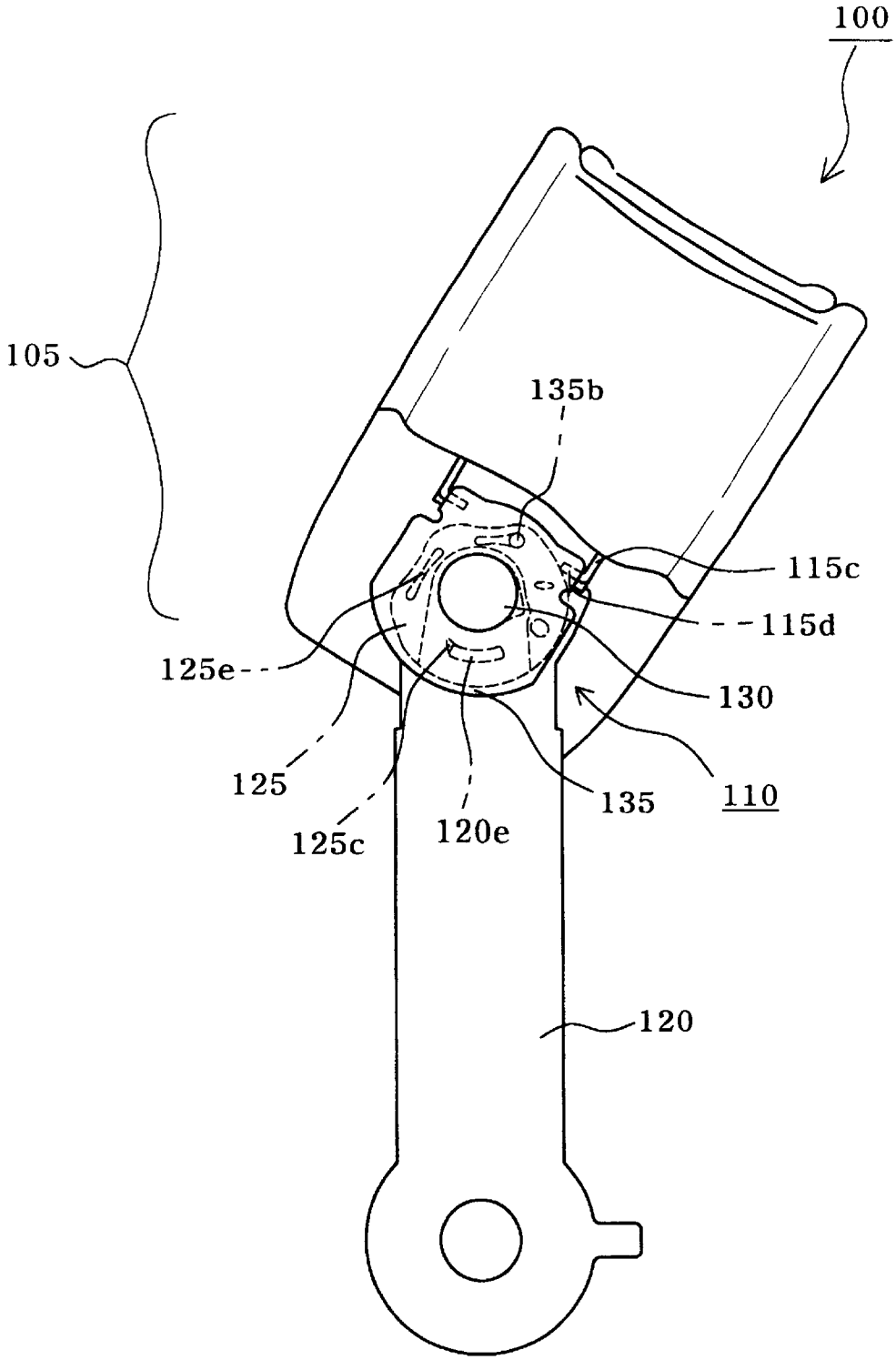
FIG. 6*b* depicts a frontal elevational view of the buckle shown in FIG. 6*a*, at its after-rotation state.
Figure 7A:
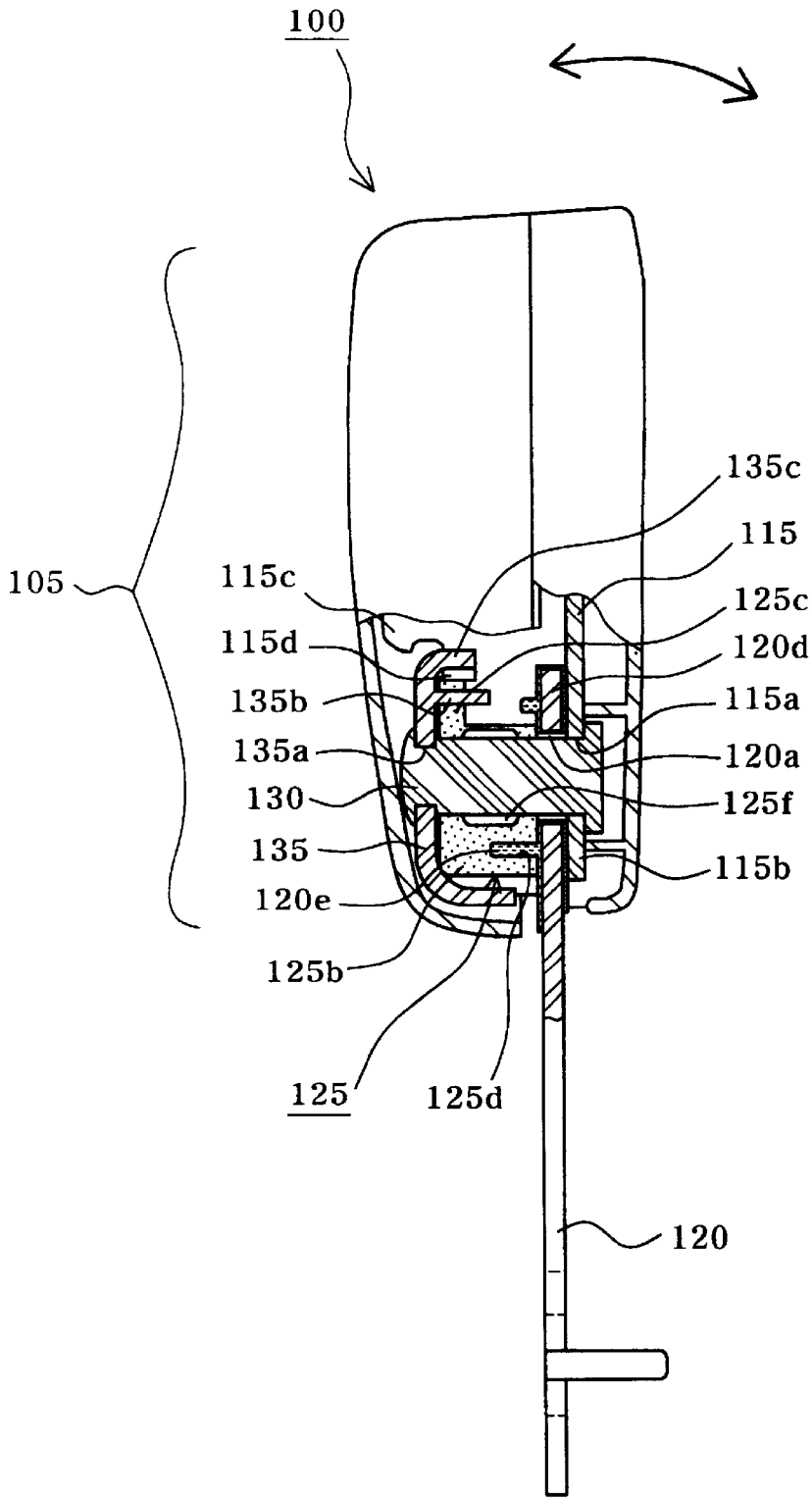
FIG. 7*a* presents a side elevational view of the buckle at its before-rotation state, which is equipped with the rotation device shown in FIG. 5 in accordance with the first embodiment of the present invention.
Figure 7B:
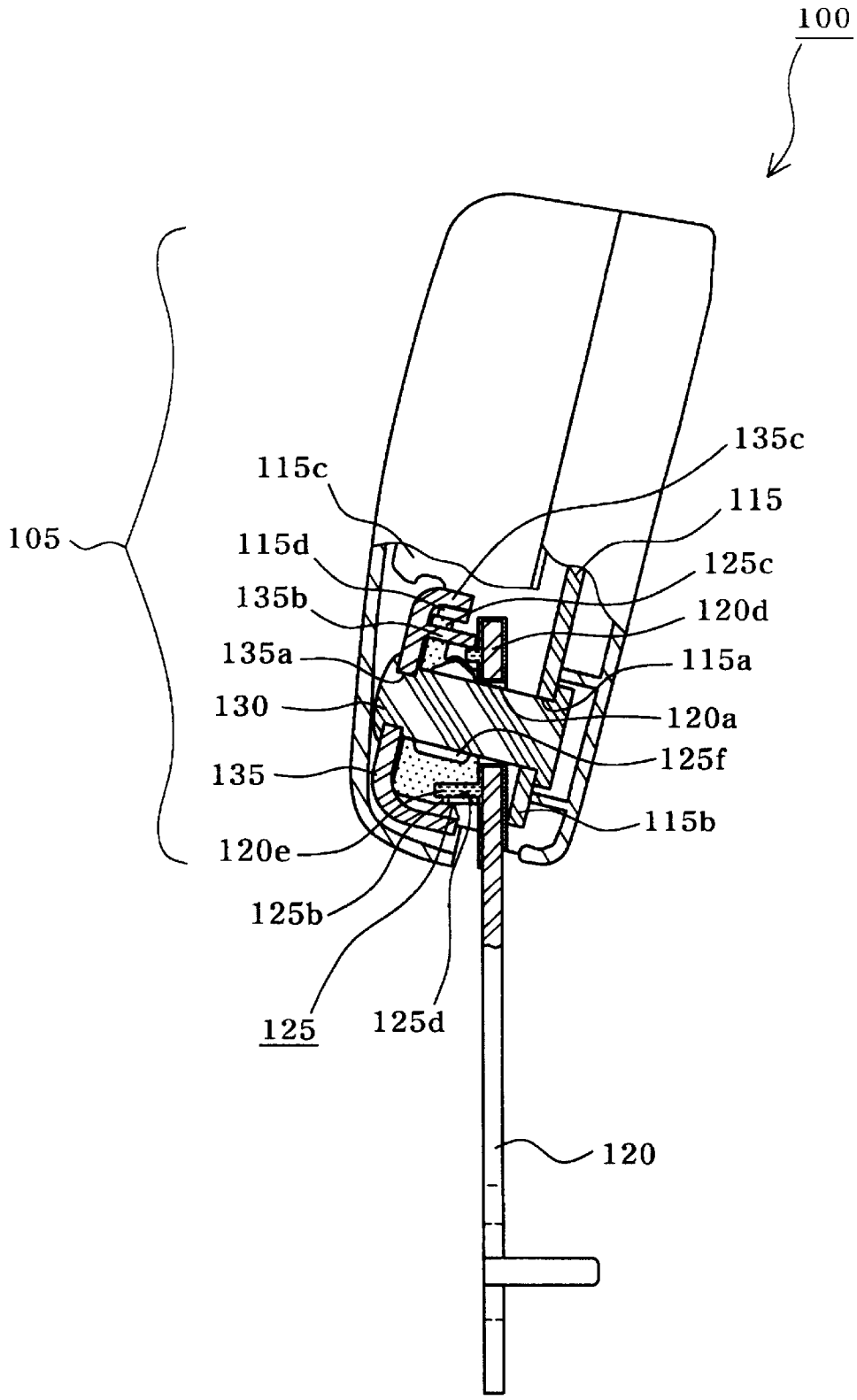
FIG. 7*b* depicts a frontal elevational view of the buckle shown in FIG. 7*a*, at its after-rotation state.
Figure 8A:
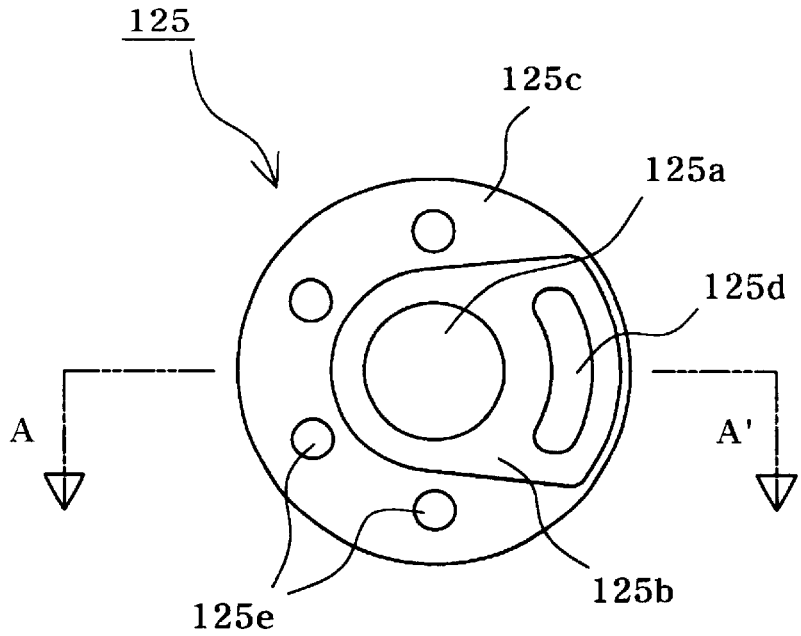
FIG. 8*a* discloses a bottom view of an elastic member of the inventive seat belt.
Figure 8B:
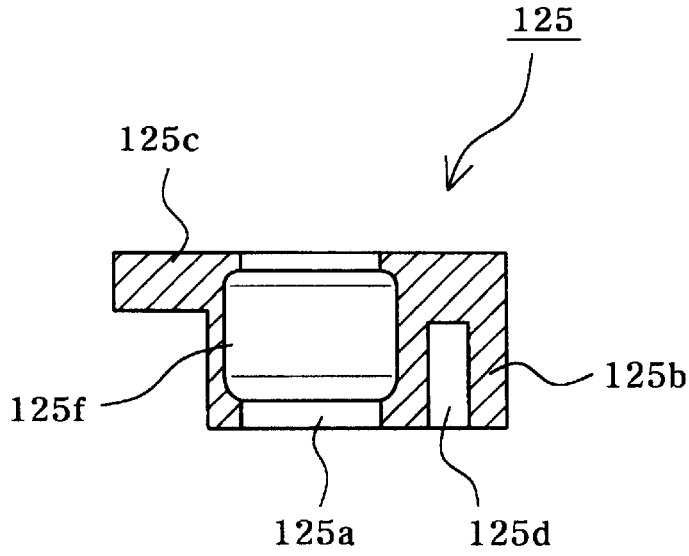
FIG. 8*b* represents a sectional view of FIG. 8*a*, when taken along a line A–A'.
Figure 9:
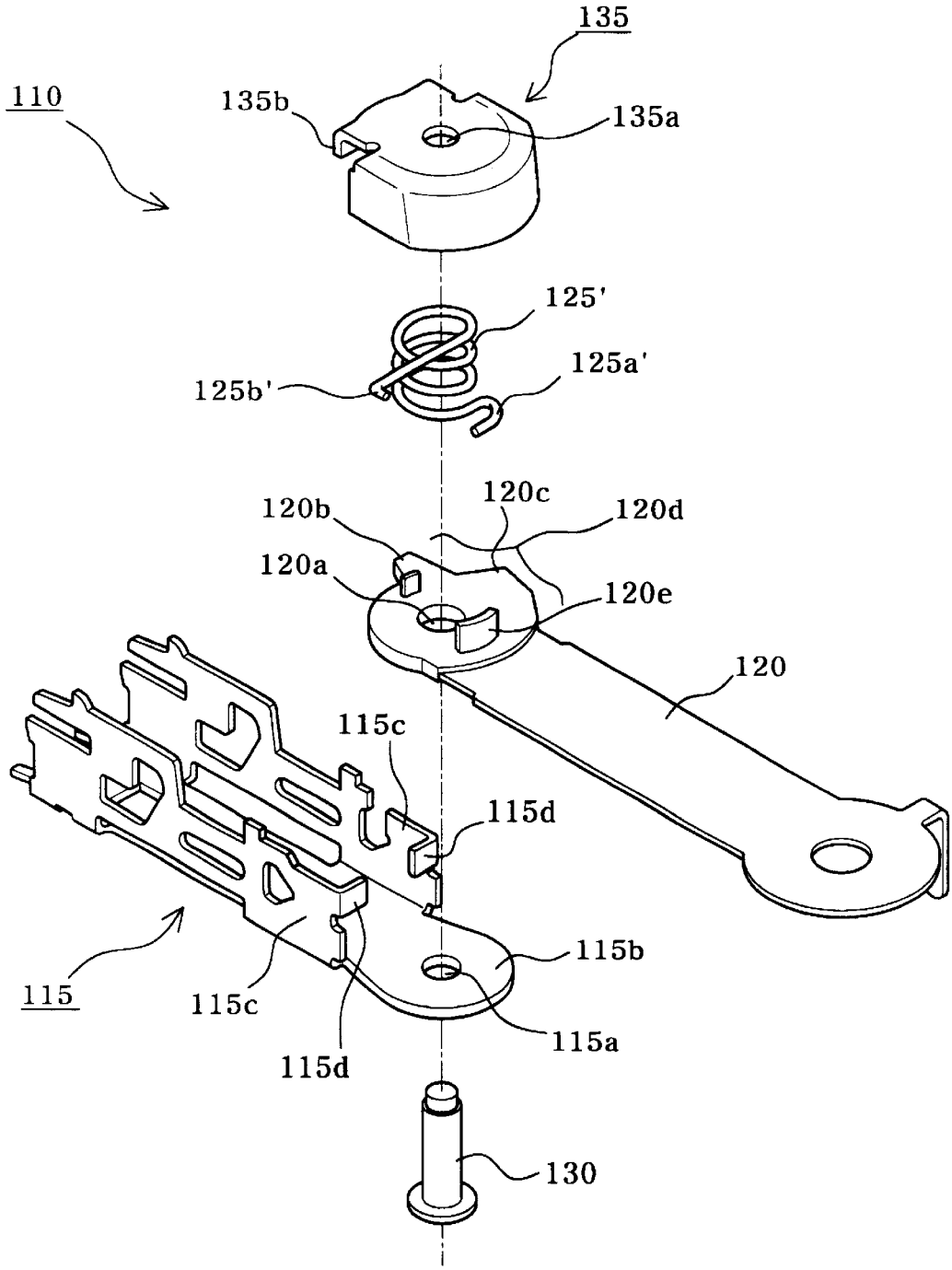
FIG. 9 illustrates an exploded perspective view of a rotation device of a buckle for use in an automobile seat belt in accordance with a second embodiment of the present invention.
Figure 10A:
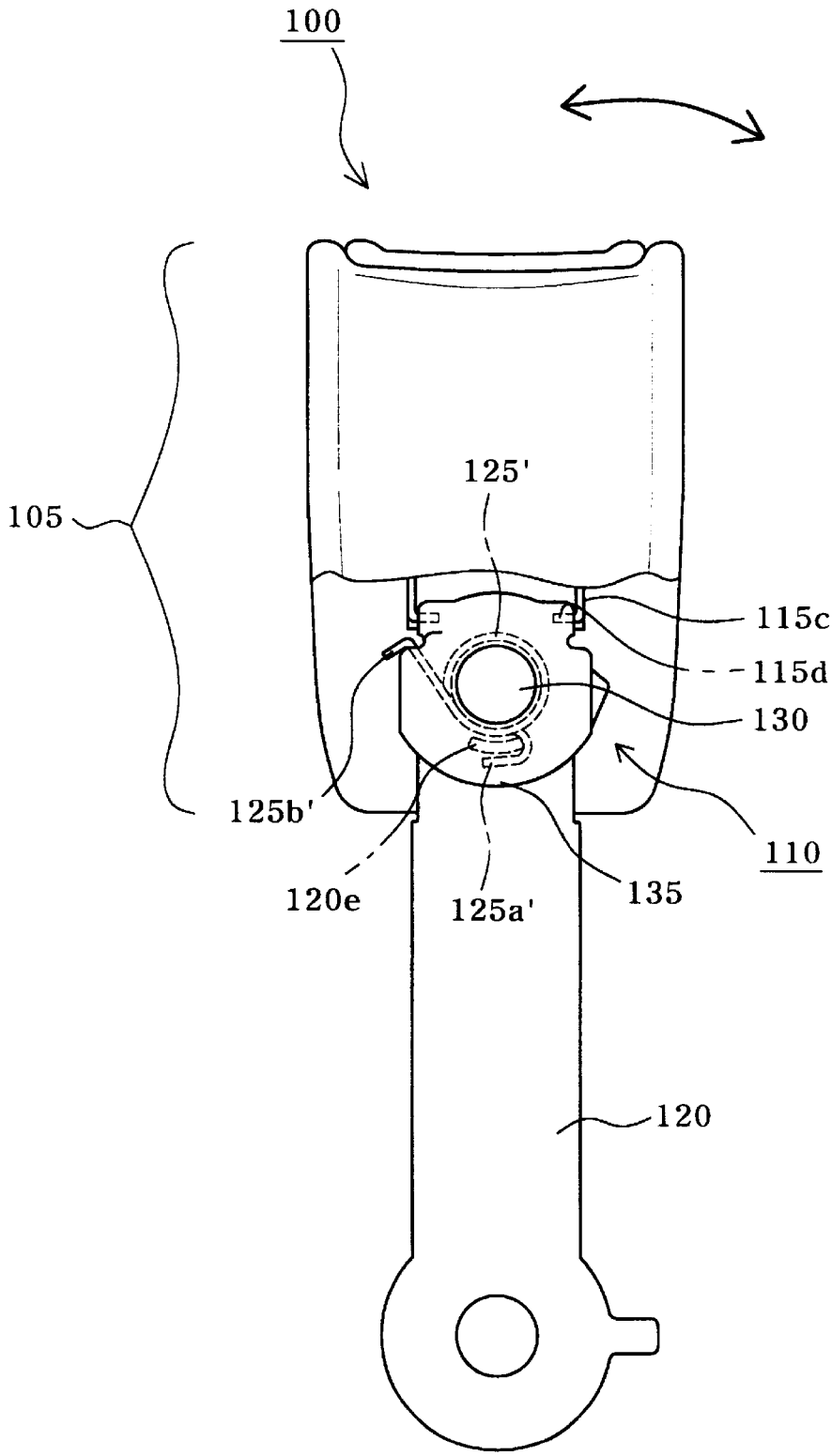
FIG. 10*a* shows a frontal elevational view of the buckle at its before-rotation state, which is equipped with the rotation device shown in FIG. 9.
Figure 10B:
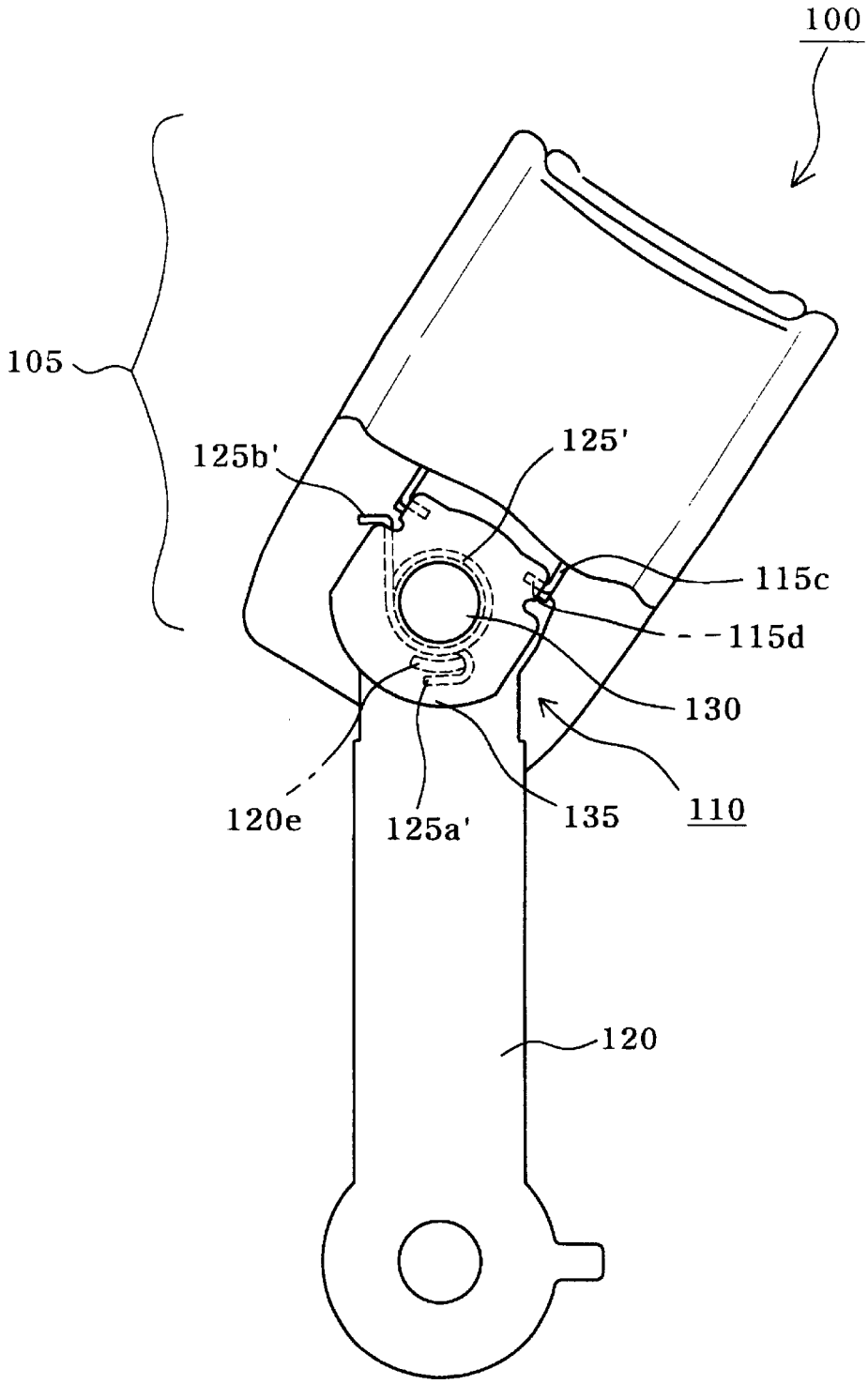
FIG. 10*b* depicts a frontal elevational view of the buckle shown in FIG. 6*a*, at its after-rotation state.
Figure 11A:
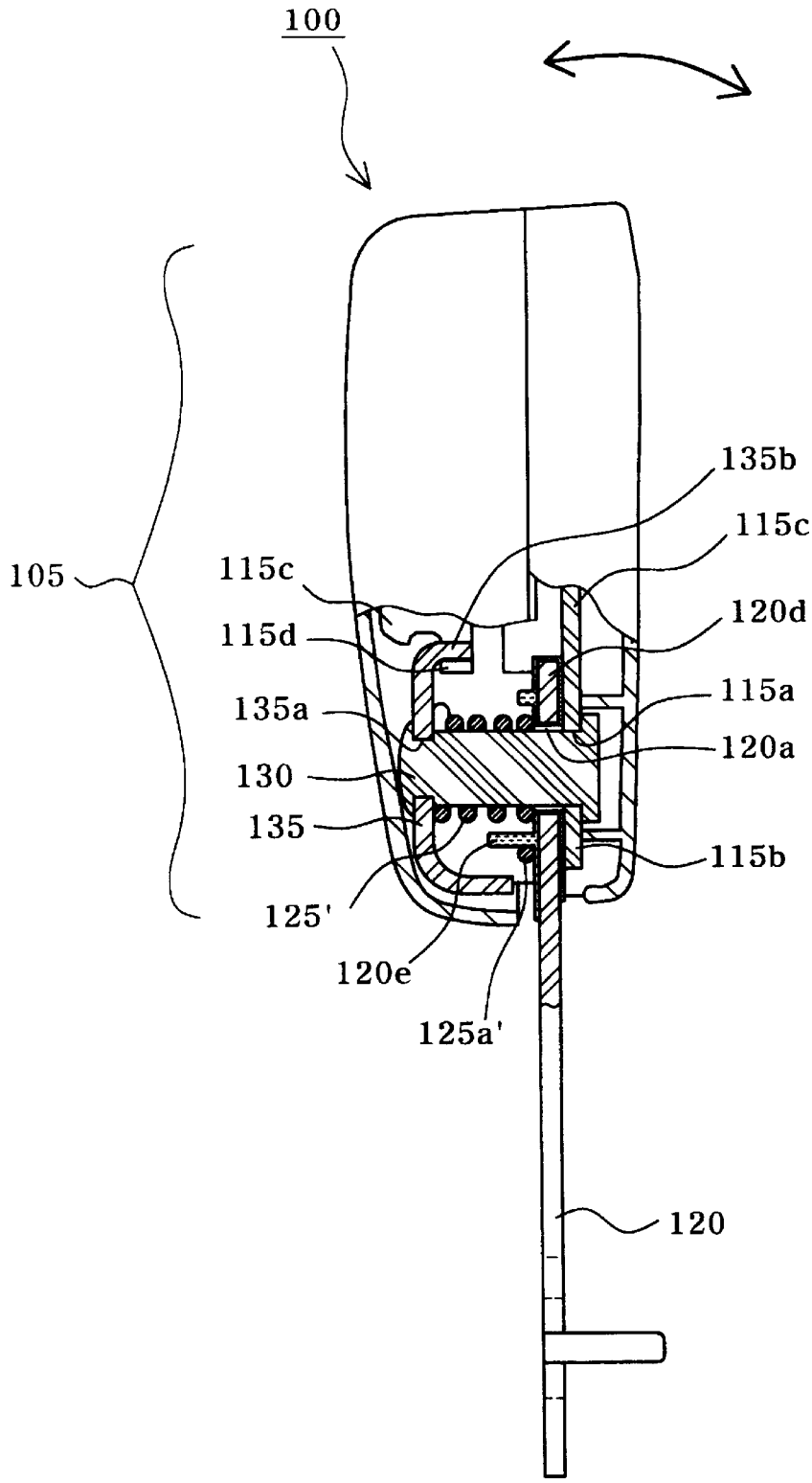
FIG. 11*a* presents a side elevational view of the buckle at its before-rotation state, which is equipped with the rotation device shown in FIG. 9 in accordance with the second embodiment of the present invention.
Figure 11B:
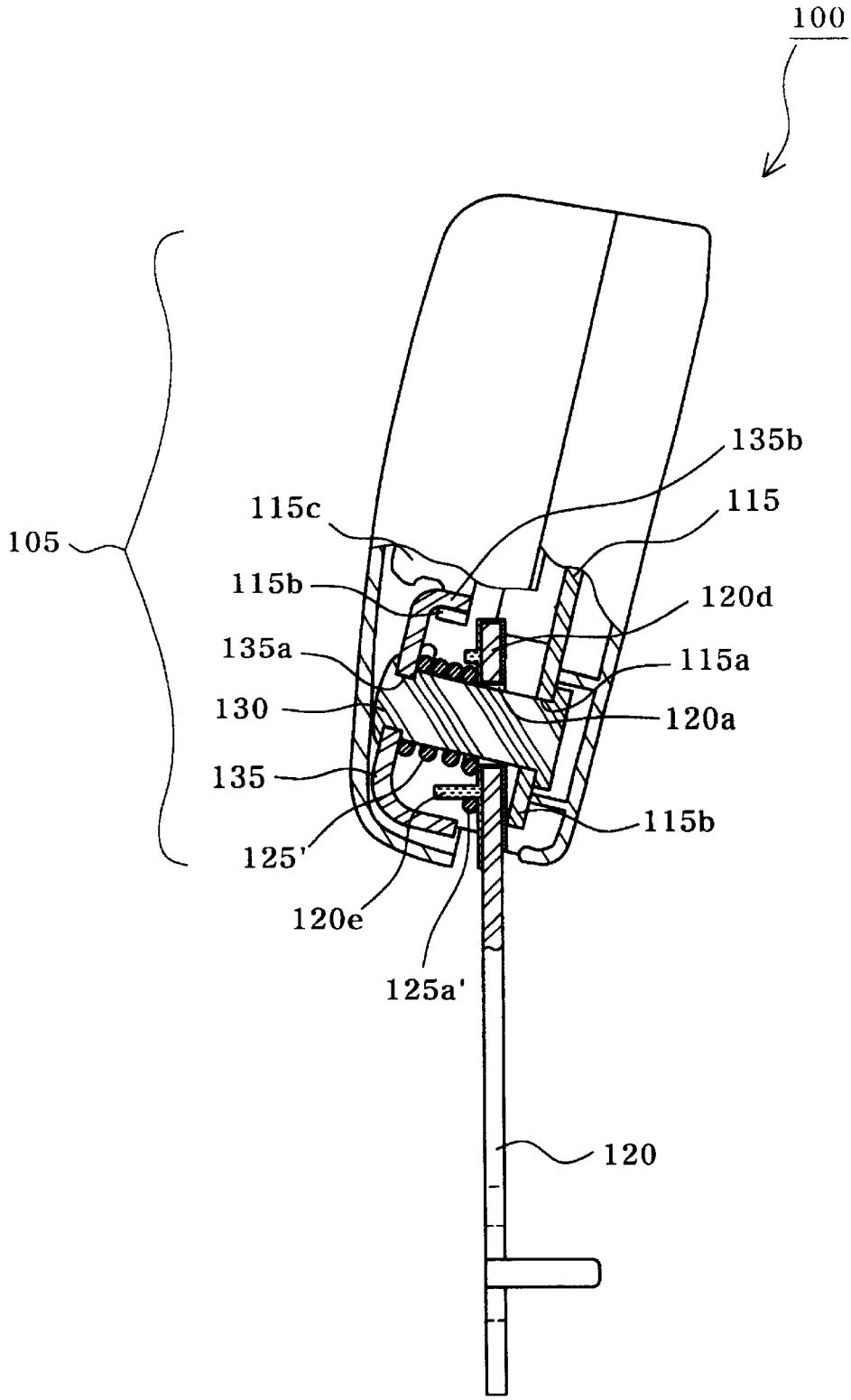
FIG. 11*b* depicts a frontal elevational view of the buckle shown in FIG. 11*a*, at its after-rotation state.

FIG. 5 shows an exploded perspective view of a rotation device of a buckle for use in an automobile in accordance with a first embodiment of the present invention.

As shown, the rotation device 110 includes a base 115 for allowing a main body 105 of the buckle 100 to be rotatable with respect to a seat, the main body 105 (see FIGS. 6*a* through 7*b*) engagable with a tongue plate (not shown), the base 115 having a plate-like shape to be mounted on a bottom surface of the main body 105 and provided with a circular plate portion 115*b* at its one end, the circular plate portion 115*b* provided with a through hole 115*a* formed therethrough, and a pair of side walls 115*c* bent upwardly each of which has a lug 115*d* bent inwardly to be integrally formed with the circular plate portion 115*b* as well as the pair of side walls 115*c*, a stalk 120 whose one end is rotatably mounted on an upper surface of the circular plate portion 120*b* of the base 115 and has a hole 120*a* formed therethrough and a stopper portion 120*d* formed around the end of the stalk 120 and provided with a protrusion 120*b* for being contacted with an inner surface of the side wall 115*c* of the base 115 and an abutment 120*c* for limiting a rotation angle of the main body 105, the stopper portion 120*d* applied with plastic material so as to reduce a noise and to ensure a proper rotational movement, the stalk 120 having a protrusion 120*e* for stopping a rotational movement, an elastic member 125 made of an urethane rubber and provided with a lower portion 125*b* mounted on an upper surface of the stalk 120, an upper portion 125*c* contacted with a bottom surface of a fixing cap 135 described later, and a through hole 125*a* formed therethrough, the lower portion having an arcuate shape containing the through hole 125*a* and a protrusion receiver 125*d* for receiving the protrusion 120*e* for stopping the rotational movement, and the upper portion having a circular cross section, the elastic member 125 having a plurality of torsional hole 125*e*, a rivet 130 inserted into through hole 115*a* of the circular plate portion 115*b* of the base 115, the holes 120*a*, 125*a* of the stalk 120 and the elastic spring 125, and the fixing cap 135 having a hole 135*a* for receiving an upper portion of the rivet 130 to fix the components therebetween, a lug 135*c* formed at one side thereof to be engaged with the lug 115*d* formed with the side walls 115*c* of the base 115, and an insertion protrusion 135*b* inserted into the torsional hole 125*e* of the elastic member 125 to allow the elastic member 125 to be assembled at its twisted state when the fixing cap 135 is assembled.

An inner diameter of a hole 125*f* formed through the lower portion 125*b* of the elastic member 125 is larger than that of the through hole 125*a* of the upper portion 125*c*. As a result, the lower portion 125*b* is more easily twisted or compressed than the upper portion 125*c*.

On the other hand, the elastic member 125 may be made of one or compound of the group including urethane, rubber and silicon. Further, as shown in FIGS. 9 through 11*b*, an elastic member 125' of a coil spring whose one end is contacted with the protrusion 120*e* for stopping the rotational movement formed at the stopper portion 120*d* of the stalk 120, while the other being kept on a peripheral surface of the fixing cap 135 may be used. The elastic member 125' of a coil spring is coated with silicon, plastic and rubber for restraining from noise during a operation.

An upper portion of the rivet 130 protruding over through the hole 135*a* of the fixing cap 135 is pressed and widened in its diameter to fix the rivet 130 to the fixing cap 135.

The rotation device constructed in this manner is mounted on a rear portion of the buckle. If the main body 105 of the buckle is rotated for an engagement with the tongue plate provided in a belt webbing (not shown), as shown in FIGS. 5 through 8*b*, the main body 105 of the buckle is rotated about the rivet 130 which is inserted from a bottom surface of the through hole 115*a* of the circular plate portion 115*b* of the base 115 of the rotation device to hold the components in an upward and a downward, and a leftward and a rightward directions. When the tongue plate is released, the main body 105 is rotated to its initial state by an elastic force caused by the elastic member 125.

That is, the protrusion 120*e* for stopping the rotational movement is inserted into the protrusion receiver 125*d* formed in the lower portion 125*b* of the elastic member 125 made of urethane rubber. The insertion protrusion 135*b* protruding from the fixing cap 135 is inserted into the torsional hole 125*e* formed in the upper portion 125*c* of the elastic member 125, being twisted by a predetermined amount. In this state, if the main body 105 is rotated in a forwarding direction or a rightward direction, twist occurs between the stopper portion 120*d* of the stalk 120 and the bottom surface of the fixing cap 135 about the protrusion receiver 125*d* formed in the lower portion 125*b* of the elastic member 125. At the same time, since the hole 125*f* has a larger diameter, the lower portion 125*b* is pressurized when the main body 105 is rotated in the forwarding direction.

When the tongue plate is released from the main body 105, the main body 105 is returned to its initial state by the fixing cap 135, the upper portion 125*c* of the elastic member 125 twisted on the upper surface of the stalk 120, and the pressurized lower portion 125*b*.

On the other hand, another embodiment of the present invention is shown in FIGS. 9 through 11*b*. As shown, a coil elastic spring 125' whose one end is contacted to the protrusion 120*e* for stopping the rotational movement protruding from the stopper portion 120*d* of the stalk 120, while the other end is abutted to the peripheral surface of the fixing cap 135 is used to return the main body 105 after the rotation.

The elastic member 125 made of urethane rubber may protect the vehicle occupant, when a crash occurs. That is, when the belt webbing exerts limitation force against the forwarding movement of the vehicle occupant, a further twist and compression of the upper portion 125*c* and the lower portion 125*b* of the elastic member 125 may absorb, in part, the shock to protect the vehicle occupant.

The present invention does not necessitate a collar needed in the prior art and reduces the manufacturing cost and the manufacturing time.

Further, in the present invention, since the stalk is applied with plastic material, the noise occurring when the stalk comes into a contact with the elastic member (or a coil elastic spring) is reduced Although the invention has been shown and described with respect to the preferred embodiments, it will be understood by those skilled in the art that various changes and modifications may be made without departing from the spirit and scope of the invention as defined in the following claims.

What is claimed is:

1. A rotation device of a buckle for use in an automobile seat belt comprising:

a base having a generally plate-shaped portion to be mounted on a bottom surface of a main body and provided with a circular plate portion at its one end, the circular plate portion provided with a through hole formed therethrough, and a pair of side walls bent upwardly each of which has a lug bent inwardly to be integrally formed with the circular plate portion as well as the pair of side walls;

a stalk whose one end is rotatably mounted on an upper surface of the circular plate portion of the base and has a hole formed therethrough and a stopper portion formed around the end of the stalk and provided with a protrusion for being contacted with an inner surface of the side wall of the base and an abutment for limiting a rotation angle of the main body, the stalk having a protrusion for stopping a rotational movement;

an elastic member whose one end is contacted to the protrusion for stopping a rotational movement and having an elasticity and a through hole formed therethrough, so that the elastic member provide a restoring force when the main body is rotated;

a rivet inserted into through hole of the circular plate portion of the base, the holes of the stalk and the elastic spring; and a fixing cap having a hole for receiving an upper portion of the rivet to fix the components therebetween, a lug formed at one side thereof to be engaged with the lug formed with the side walls of the base.

2. The rotation device of claim 1, wherein the elastic member is provided with a lower portion mounted on an upper surface of the stalk, an upper portion contacted with a bottom surface of the fixing cap, the lower portion having an arcuate shape containing the through hole and a protrusion receiver for receiving the protrusion for stopping the rotational movement, and the upper portion having a circular cross section, and a plurality of torsional holes formed through the elastic member.

3. The rotation device of claim 1, wherein the stopper portion of the stalk is applied with plastic material.

4. The rotation device of claim 1, wherein the fixing cap is provided with an insertion protrusion inserted into the torsional hole of the elastic member to allow the elastic member to be assembled at its twisted state when the fixing cap is assembled.

5. The rotation device of claim 1, wherein the elastic member is made of one or compound of the group including the urethane, the rubber and the silicon.

6. The rotation device of claim 1, wherein the elastic member is of a coil spring whose one end is contacted with the protrusion for stopping the rotational movement formed at the stopper portion of the stalk, while the other being kept on a peripheral surface of the fixing cap.

7. The rotation device of claim 5, wherein an inner diameter of a hole formed through the lower portion of the elastic member is larger than that of the through hole of the upper portion.

8. The rotation device of claim 6, wherein the elastic member of a coil spring is coated with silicon, plastic and rubber.

* * * * *